US008639136B2

(12) United States Patent
Tomura et al.

(10) Patent No.: US 8,639,136 B2
(45) Date of Patent: Jan. 28, 2014

(54) IMAGE FORMING APPARATUS

(75) Inventors: Hisayuki Tomura, Izunokuni (JP); Takao Nada, Numazu (JP); Kenichi Iida, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 171 days.

(21) Appl. No.: 13/369,450

(22) Filed: Feb. 9, 2012

(65) Prior Publication Data

US 2012/0207494 A1 Aug. 16, 2012

(30) Foreign Application Priority Data

Feb. 10, 2011 (JP) ..... 2011-027156

(51) Int. Cl.
*G03G 15/01* (2006.01)

(52) U.S. Cl.
USPC ..... 399/40; 399/396

(58) Field of Classification Search
USPC ..... 399/40, 301–303, 396
See application file for complete search history.

(56) References Cited

U.S. PATENT DOCUMENTS

| | | | | |
|---|---|---|---|---|
| 6,904,251 | B2 | 6/2005 | Uyama et al. | |
| 6,934,498 | B2 | 8/2005 | Kobayashi et al. | |
| 6,947,695 | B2 | 9/2005 | Iida et al. | |
| 6,956,594 | B2 | 10/2005 | Iida et al. | |
| 6,980,749 | B2 | 12/2005 | Yoda et al. | |
| 6,987,939 | B2 | 1/2006 | Ishiyama et al. | |
| 6,999,689 | B2 | 2/2006 | Kinoshita et al. | |
| 7,043,183 | B2 | 5/2006 | Yoda et al. | |
| 7,054,587 | B2 * | 5/2006 | Sohmiya et al. | 399/309 |
| 7,095,972 | B2 * | 8/2006 | Iwai | 399/299 |
| 7,162,167 | B2 | 1/2007 | Iida et al. | |
| 7,224,932 | B2 * | 5/2007 | Omata | 399/400 |
| 7,647,015 | B2 | 1/2010 | Kubota et al. | |
| 7,957,659 | B2 | 6/2011 | Nada et al. | |
| 2004/0109708 | A1 | 6/2004 | Kobayashi et al. | |
| 2004/0184854 | A1 * | 9/2004 | Giannetti et al. | 399/400 |
| 2007/0059027 | A1 * | 3/2007 | Ishikawa et al. | 399/101 |
| 2008/0292335 | A1 | 11/2008 | Kubota et al. | |
| 2011/0013950 | A1 * | 1/2011 | Furuya et al. | 399/302 |
| 2011/0026951 | A1 * | 2/2011 | Nishizaki | 399/39 |
| 2011/0097096 | A1 * | 4/2011 | Sueoka | 399/49 |
| 2011/0135332 | A1 | 6/2011 | Iida et al. | |

(Continued)

FOREIGN PATENT DOCUMENTS

| | | |
|---|---|---|
| JP | 62-226167 A | 10/1987 |
| JP | 2004-139036 A | 5/2004 |

(Continued)

*Primary Examiner* — G. M. Hyder
(74) *Attorney, Agent, or Firm* — Fitzpatrick, Cella, Harper & Scinto

(57) ABSTRACT

An image forming apparatus includes an image carrying belt for carrying a toner image; an image forming station for forming toner image on the image carrying belt; a sheet feeding belt for feeding a sheet; a transfer member for transferring the toner image from the carrying belt onto the sheet fed on the feeding belt; and a controller for controlling speeds of the carrying belt and the feeding belt. The controller is capable of controlling a relative speed between the carrying belt and the feeding belt at multiple levels. The image forming station forms a first toner pattern on the carrying belt in a state that the relative speed is at a first level, and forms a second toner pattern on the carrying belt in a state that the relative speed is at a second level which is different from the first level. The transfer member transfers the first toner pattern and the second toner pattern onto the sheet carried on the feeding belt.

10 Claims, 16 Drawing Sheets

(56) References Cited

U.S. PATENT DOCUMENTS

| | | | | |
|---|---|---|---|---|
| 2011/0194866 | A1 | 8/2011 | Nanataki et al. | |
| 2011/0194879 | A1 | 8/2011 | Nomura et al. | |
| 2011/0255909 | A1 | 10/2011 | Tomura et al. | |
| 2013/0028628 | A1* | 1/2013 | Toyama et al. | 399/101 |

FOREIGN PATENT DOCUMENTS

| | | | |
|---|---|---|---|
| JP | 2005-31161 | A | 2/2005 |
| JP | 2006-30451 | A | 2/2006 |
| JP | 2006-215250 | A | 8/2006 |
| JP | 4058648 | B1 | 3/2008 |

* cited by examiner (a)

(b)

2ry TRANSFER BELT SPEED & IMAGE BLURRING

| BELT SPEED | -1.1% | -1.0% | -0.9% | -0.8% | -0.7% | -0.6% | -0.5% | -0.4% | -0.3% | -0.2% | -0.1% |
|---|---|---|---|---|---|---|---|---|---|---|---|
| BLURRING | D | D | C | A | A | A | A | B | C | D | D |

(a)

(b)

(a)

| COUNTS | END MARGINS (mm) | | | | |
|---|---|---|---|---|---|
| | 0 | 10 | 50 | 75 | 100 |
| 1 | D | D | C | B | A |
| 2 | D | D | C | B | A |

(b)

IMAGE FORMING APPARATUS

FIELD OF THE INVENTION AND RELATED ART

The present invention relates to an image forming apparatus, such as a copying machine, a printer, a facsimile machine, etc., which forms an image with the use of an electrophotographic or electrostatic image forming method.

There have been in use various image forming apparatuses which have two or more image forming stations and sequentially transfer two or more monochromatic images formed of toner (which hereafter may be referred to simply as toner images), onto their intermediary transfer belt. If the intermediary transfer belt of any of the image forming apparatuses of this type changes in speed during the formation of an image, the multiple monochromatic toner images, different in color, fail to be transferred onto a preset position on a sheet of recording medium, resulting in the formation of a multicolor image which suffers from color deviation.

One of the methods for preventing the formation of a multicolor image which suffers from color deviation is proposed in Japanese Laid-open Patent Application No. 62-226167. More concretely, according to this patent application, a toner image is formed in a preset pattern on the peripheral surface of a photosensitive drum, and the peripheral velocity of the photosensitive drum is detected by a sensor, based on the detected interval of the adjacent two markings of the pattern. Then, the results of the detection is fed back to the circuit for controlling the recording medium conveyance belt as a transfer medium bearing member in order to match the moving speed of the recording medium conveyance belt with the peripheral velocity of the photosensitive drum.

Another solution to the above-described problem is disclosed in Japanese Laid-open Patent Application No. 2004-139036. In the case of the image forming apparatus disclosed in this patent application, multiple monochromatic images are formed in a preset pattern on an image bearing member. Then, the monochromatic toner images, different in color, are detected by a sensor to obtain a speed V1, which is the speed at which the image bearing member moves when an image is not being formed (sheet of recording medium is not being conveyed), and a speed V2, which is the speed at which the image bearing member moves when an image is being formed (sheet of recording medium is being conveyed). Then, the amount of the difference ΔV between the two speeds V1 and V2 is calculated (ΔV=V1−V2), and the driving of the image bearing member is controlled based on the value of ΔV, in order to prevent the formation of an image which suffers from the color deviation.

However, in a case where an image forming apparatus is structured so that its transfer station is formed by placing its image bearing belt in contact with its recording medium conveyance belt, and also, so that its section for driving the image bearing member is independently controlled from its section for driving the recording medium conveyance belt, it is possible that the amount of the friction between the image bearing belt and recording medium belt will fluctuate. The fluctuation in the amount of the friction between the image bearing belt and recording medium conveyance belt affects the moving speed of the image bearing belt, which in turn possibly will result in the formation of an image which suffers from the color deviation. In other words, in the case where an image forming apparatus is structured as described above, it is difficult to prevent the formation of an image suffering from the color deviation, by detecting monochromatic toner images, which are in a preset pattern, with the use of a sensor, as disclosed in Japanese Laid-open Patent Applications Nos. 62-226167 and 2004-139036.

SUMMARY OF THE INVENTION

Thus, the primary object of the present invention is to provide an image forming apparatus which is structured so that its transfer station is the interface between its image bearing belt and recording medium conveyance belt which are circularly moved by two belt driving sections independent from each other, and yet, the moving speed of the image bearing belt and that of the recording medium conveyance belt are not affected by the changes in the amount of friction between the two belts.

According to an aspect of the present invention, there is provided an image forming apparatus comprising an image carrying belt, movable along an endless path, for carrying a toner image; a first driver for rotating said image carrying belt along the endless path; an image forming station for forming a toner image on said image carrying belt; a sheet feeding belt, movable along an endless path, for feeding a sheet; a transfer member for transferring the toner image from said image carrying belt onto the sheet fed on said sheet feeding belt; a second driver for rotating said sheet feeding belt along the endless path; and a controller for controlling a moving speed of said image carrying belt and a moving speed of said sheet feeding belt, wherein said controller is capable of controlling a relative speed between said image carrying belt and said sheet feeding belt at a plurality of levels, wherein said image forming station forms a first toner pattern on said image carrying belt in a state that the relative speed is at a first level, and forms a second toner pattern on said image carrying belt in a state that the relative speed is at a second level which is different from the first level, and wherein said transfer member transfers the first toner pattern and the second toner pattern onto the sheet carried on said sheet feeding belt.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 7(*b*) is a drawing which shows the relationship between the speed of the secondary transfer belt and the image magnification ratio.

FIG. 10(*b*) is a table which shows the relationship between the lateral margin and the ranking of the image blurring.

DESCRIPTION OF THE PREFERRED EMBODIMENTS

Hereinafter, the preferred embodiments of the present invention are described in detail with reference to the appended drawings. However, the measurements, materials, and shapes of the structural components of the following preferred embodiments of the present invention, and the positional relationships among the structural components, are not intended to limit the present invention in scope. That is, they should be modified according to the structure of the apparatus to which the present invention is to be applied, and the various conditions required of the apparatus. That is, the following embodiments are not intended to limit the present invention in scope unless specifically noted.

(Embodiment 1)

The image forming apparatus in this embodiment is a color image forming apparatus of the so-called tandem type. It has multiple (four) image formation stations which have their own image bearing member. The multiple image formation stations form multiple (four) monochromatic images of toner, one for one, and are different in the color of the monochromatic toner images they form.

Figure 1:
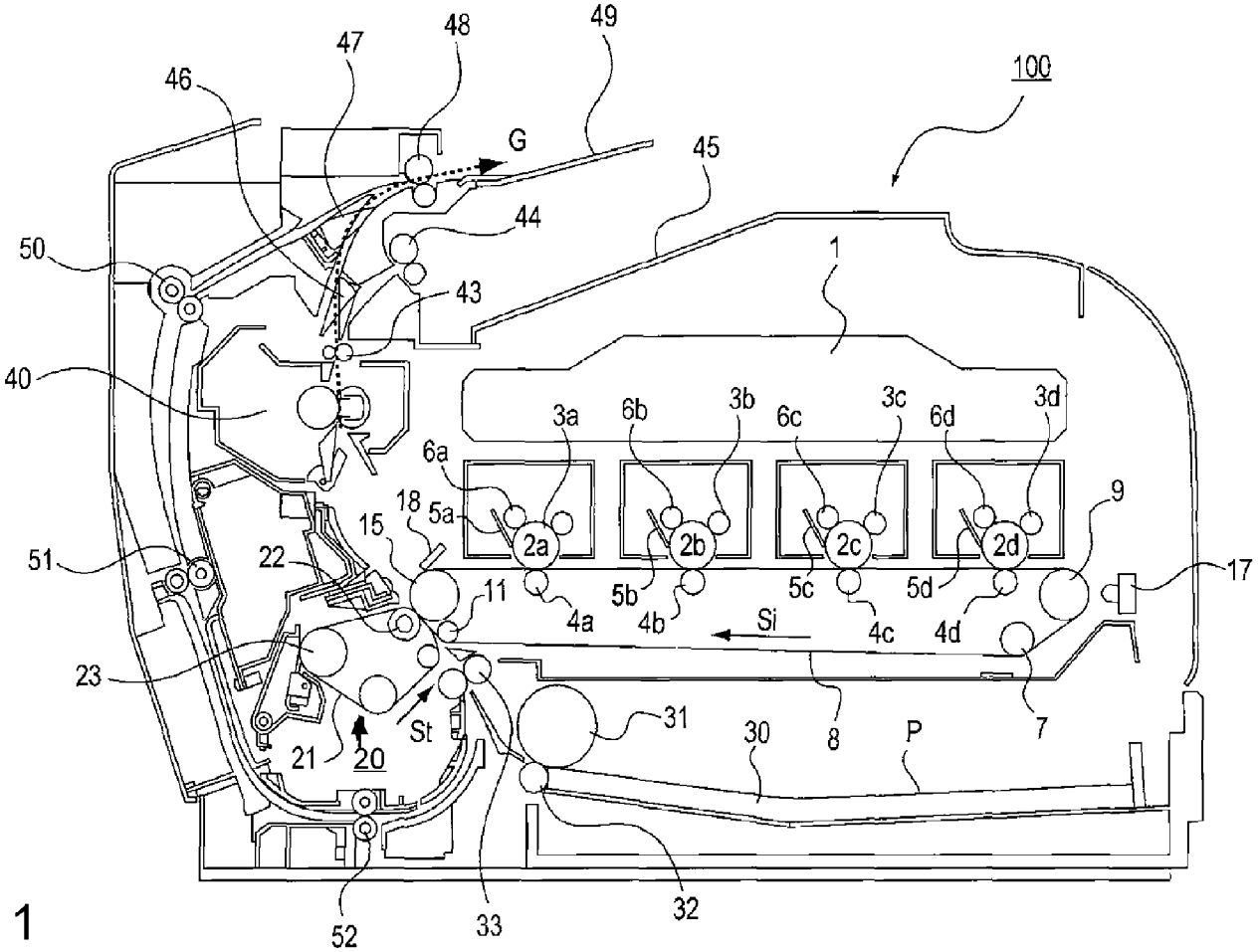
FIG. 1 is a schematic sectional view of the image forming apparatus in the first preferred embodiment of the present invention, and shows the structure of the apparatus.

FIG. 1 is a schematic sectional view of the image forming apparatus in this embodiment, and shows the general structure of the apparatus. Referring to FIG. 1, the image forming apparatus 100 has four image formation stations, which are in horizontal alignment. Each image formation station is provided with its own photosensitive member (photosensitive drum) 2 (2*a*, 2*b*, 2*c* or 2*d*) which is in the form of a drum. Each drum 2 is horizontal and perpendicular to the direction in which the four image formation stations are aligned. Since the four image formations are virtually the same in structure, only the image formation station having a photosensitive drum 2*a* for forming a toner image of yellow color, is described.

The photosensitive drum 2*a* is charged by a primary charging device 6*a*, and is exposed by an exposing device 1, whereby an electrostatic latent image is formed on the peripheral surface of the photosensitive drum 2*a*. The electrostatic latent image is developed into a visible image, that is, an image formed of yellow toner (which hereafter may be referred to simply as a yellow toner image), with the use of yellow toner. The yellow toner image is transferred onto an intermediary transfer belt (image bearing belt) 8 by a primary transfer roller 4*a* as the primary transferring member. The transfer residual toner, that is, the toner remaining adhered to the peripheral surface of the photosensitive drum 2*a* after the primary transfer, is removed by a cleaning device 5.

Similarly, magenta, cyan, and black monochromatic toner images are formed on the peripheral surfaces of the photosensitive drums 2*b*, 2*c* and 2*d*, respectively, and are transferred (primary transfer) in layers onto the intermediary transfer belt 8.

The four monochromatic toner images (different in color) layered on the intermediary transfer belt 8 are moved into the second transfer station by the circular movement of the intermediary transfer belt 8 in the direction indicated by an arrow mark.

Meanwhile, the sheets P of recording medium stacked in a sheet feeder cassette 30 are moved out of the cassette 30, and then, are moved into the main assembly of the image forming apparatus 100, one by one, while being separated from the rest, by a combination of a feed roller 30 and a separation roller 32. Then, each sheet P is sent to a pair of registration rollers 33, which corrects the sheet P in attitude. Then, while the sheet P is conveyed through the second transfer station which the intermediary transfer belt 8 and a second transfer unit 20 form, the four monochromatic toner images (different in color) on the intermediary transfer belt 8 are transferred (secondary transfer) onto the sheet P. After the transfer of the four monochromatic toner images (different in color) onto the sheet P, the sheet P is pulled through a fixing device 40 by a pair of recording medium conveyance rollers 43 of the fixing device 40, while the toner images are fixed to the sheet P. Then, the sheet P is discharged into a delivery tray 45 by a pair of discharge rollers 44. The transfer residual toner, that is, the toner remaining on the intermediary transfer belt 8 after the secondary transfer is removed by an intermediary transfer belt cleaner 18, which is in the adjacencies of a roller 15 which opposes a second transfer roller 22 with the presence of the intermediary transfer belt 8 between itself and roller 22.

When the image forming apparatus 100 is in the two-side mode, a discharge flapper 46 and a two-side mode flapper 47 are changed in attitude from the positions in which they are in when the image forming apparatus 100 is in the one-side mode. Thus, after the fixation of the toner images to the first surface of the sheet P, the sheet P is temporarily guided onto a two-side mode tray 49 by a pair of reversal conveyance rollers 48 for the two-side mode, by way of the pair of roller 43 of the fixing device 40. During this conveyance of the sheet P, the trailing end portion of the sheet P remains pinched by the pair of reversal conveyance rollers 48. Thus, after being temporarily conveyed into the two-side mode tray 49, the sheet P is pulled back into the main assembly of the image forming apparatus 100 by the reversal rotation of the two-side mode reversal rollers 48. Then, the sheet P is conveyed to the pair of registration rollers 33 for the second time, by a pair of recording medium conveyance rollers 50, a pair of recording medium conveyance rollers 51, and a pair of recording medium conveyance rollers 53, and then, is conveyed to the secondary transfer station through a nip between the pair of registration rollers 33. Then, the next set of toner images is transferred onto the second surface of the sheet P.

The intermediary transfer belt 8 is an endless belt. It is supported by an intermediary transfer belt driving roller 9, the tension roller 15, a tension roller 7, and a tension roller 11. It is circularly moved in the clockwise direction, in FIG. 1, at a peripheral velocity of Si, by the rotation of the intermediary transfer belt driving roller 9 which receives driving force from a motor 64 as the first mechanical power source. The motor 64 and intermediary transfer belt driving roller 9 make up the first driving section which circularly moves the intermediary transfer belt 8. The intermediary transfer belt tension roller 7 is kept pressed in one direction by an intermediary transfer belt tension spring 16, being thereby provided with a preset mount of tension.

The image forming apparatus 100 is provided with a section for detecting the position of the color deviation detection pattern formed of toner on the intermediary transfer belt 8. The section is positioned so that it opposes the intermediary transfer belt driving roller 9. More concretely, the section for detecting the position of the color deviation detection pattern formed on the intermediary transfer belt 8 is provided with a pair of optical sensors of the reflection type (which hereafter may be referred to simply as color deviation sensor 17), which are at the lengthwise ends of the intermediary transfer belt driving roller 9, one for one. The color deviation sensor 17 is positioned so that it can detect the color deviation detection pattern when the portion of the intermediary transfer belt 8, on which the pattern is preset, is wrapped around the intermediary transfer belt driving roller 9.

The afore-mentioned secondary transfer unit 20 opposes the roller 15 which opposes the second transfer roller 22, with the presence of the intermediary transfer belt 8 between itself and the roller 15. The secondary transfer unit 20 has a secondary transfer belt 21, which is kept in contact with the intermediary transfer belt 8. The area of contact between the belts 21 and 8 is the secondary transfer station.

The secondary transfer belt 21 is supported by three rollers 23, 24 and 25. The roller 23 is for driving the secondary transfer belt 21. The roller 24 is for simply supporting the secondary transfer belt 21, and is rotated by the movement of the secondary transfer belt 21. The roller 25 is for providing the secondary transfer belt 21 with a preset amount of tension. The secondary transfer roller 22 is positioned so that it opposes the tension roller 11 of the intermediary transfer belt unit. The tension roller 25 of the secondary transfer belt is kept pressed in one direction by a tension spring 26 for the secondary transfer belt, providing thereby the secondary transfer belt 21 with a preset amount of tension. The secondary transfer belt 21 is circularly moved at a peripheral velocity of St by the driving roller 23 for the secondary transfer belt 21, which is rotated by the driving force which it receives from a motor 65 which is the second mechanical power source. The motor 65 and driving roller 23 make up the second driving section, that is, the section for circularly moving the secondary transfer belt 21. The secondary transfer belt 21 is a sheet conveying belt for conveying a sheet P of recording medium through the secondary transfer station, in coordination with the intermediary transfer belt 8.

Figure 2:
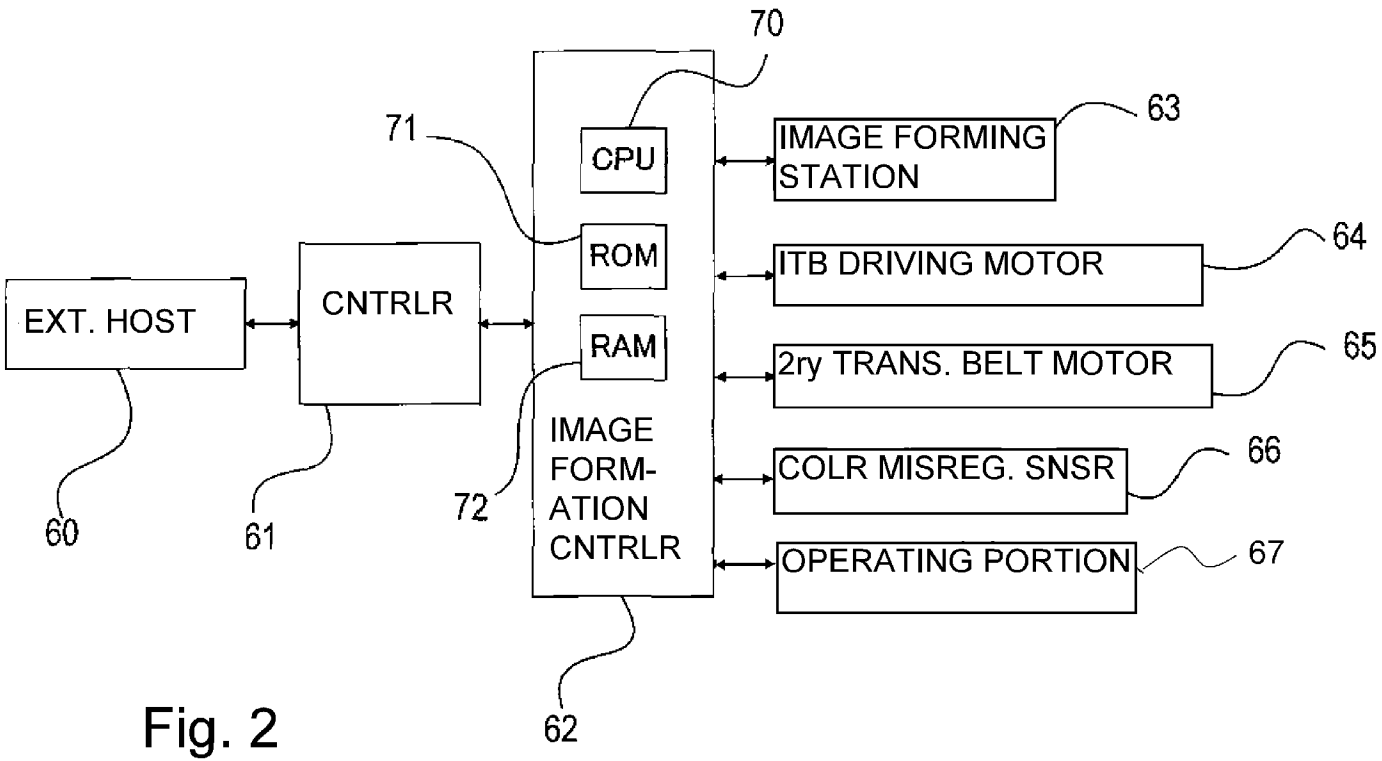
FIG. 2 is a block diagram of the control of the image forming apparatus in the first embodiment.

FIG. 2 is a block diagram of the control of the image forming apparatus 100, and shows the general structure of the control. Referring to FIG. 2, the image forming apparatus 100 receives RGB image signals from an external host device 60 such as a personal computer which is connected to the image forming apparatus 100 in such a manner that it can communicate with the apparatus 100, or a reader section (unshown) with which the image forming apparatus 100 is separately provided from the main assembly of the image forming apparatus 100 to read an original.

The control section 61 for image processing converts the received RGB signals into CMYK signals, adjusts the CMYK signals in terms of gradation and image density, and generates the exposure signals for the exposing device 1. The control section 62 for image formation integrally controls the image forming operation, and also, controls the image forming apparatus 100 with the use of the color deviation sensor 17 (patch detecting means) during the adjustment of the image forming apparatus.

The image formation controlling section 62 has a CPU 70, a ROM 71, and RAM 72. The CPU 70 is for controlling image formation process. The ROM 71 is for storing the programs and the like which are carried out by the CPU 70. The RAM 72 is for storing various data while the CPU 70 controls the image formation process.

The image forming apparatus 100 is provided with the four image formation stations for yellow, magenta, cyan, and black colors, one for one. Each image formation section 63 has the photosensitive drum 2, primary charging device 6, developing device 3, and cleaning device 5. The image formation controlling section 62 controls also the exposing device 1 shown in FIG. 1. The intermediary transfer belt driving motor 64 of the first driving section circularly moves the intermediary transfer belt 8 at a preset speed in response to a command from the image formation controlling section 62. The secondary transfer belt driving motor 65 of the secondary driving section circularly moves the secondary transfer belt 21 at a preset speed in response to the command from the image formation controlling section 62. The image formation controlling section 62 is capable of controlling each of the above-mentioned sections of the image forming apparatus 100 as it receives various commands from the control panel 67 of the image forming apparatus 100.

If the image forming apparatus 100 is structured so that its intermediary transfer belt 8 and secondary transfer belt 21 are circularly driven independently by their own driving sections, it is possible that the change in the friction between the two belts 8 and 12 will change the moving speed of the intermediary transfer belt 8.

Figure 3:
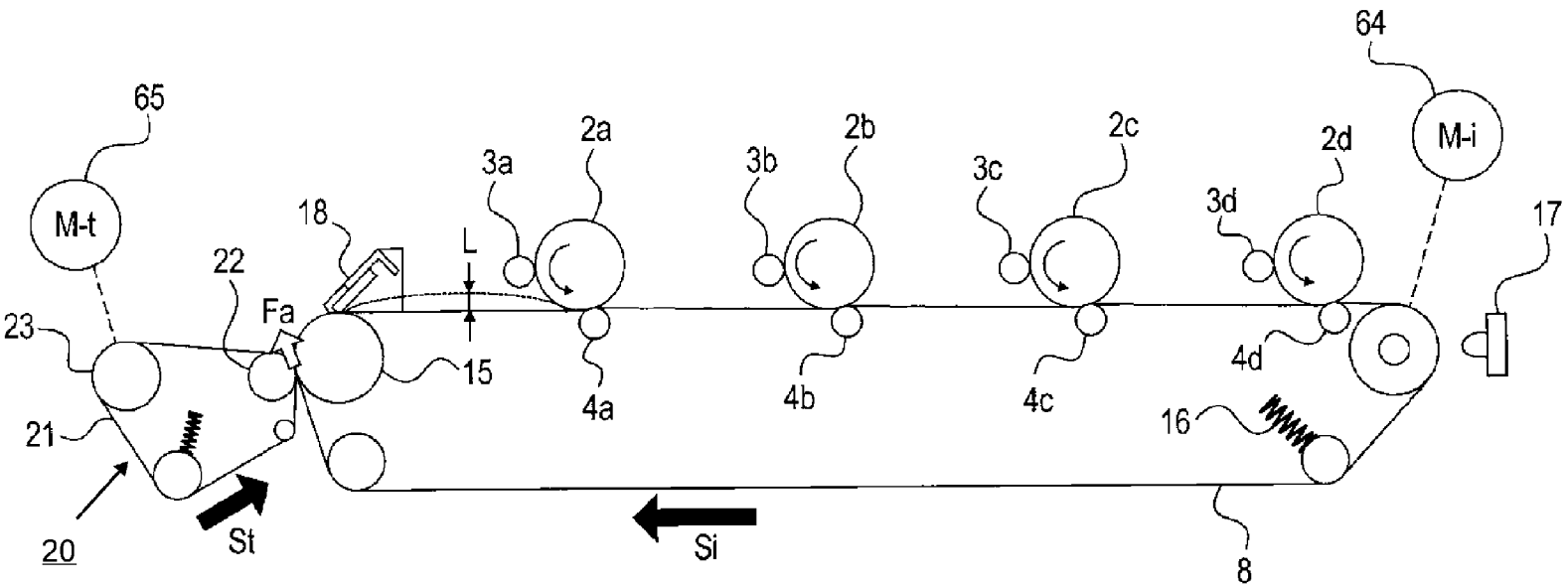
FIG. 3 is a drawing for describing the behavioral change of the intermediary transfer belt attributable to the change in the amount of friction between the image bearing belt and recording medium conveyance belt of the image forming apparatus, and the resultant formation of an image suffering from the color deviation, in the first embodiment.

FIG. 3 is a drawing for describing how and why the friction Fa between the intermediary transfer belt 8 and secondary transfer belt 21 acts in the direction opposite to the moving direction of the intermediary transfer belt 8. As is evident from FIG. 3, the intermediary transfer belt 8 receives from the friction Fa such a force that works in the direction to accelerate the intermediary transfer belt 8. Therefore, the intermediary transfer belt 8 is slackened between the intermediary transfer belt cleaner 18 and photosensitive drum 2*a* (for yellow color), by an amount L.

The moment when the intermediary transfer belt 8 and secondary transfer belt 21 begin to be moved, the friction Fa is static friction. Then, as the two belts 8 and 21 begin to move, it turns into dynamic friction. The static friction is greater than the dynamic friction. Therefore, the amount L of slack is the largest the moment when the intermediary transfer belt 8 and secondary transfer belt 21 begins to be moved. Then, as the two belts 8 and 21 begin to be circularly moved, the friction Fa becomes dynamic. Then, as the two belts 8 and 21 continue to be moved, the friction Fa (dynamic friction) gradually reduces.

Further, while the value of L is no less than zero, that is, while the intermediary transfer belt 8 and secondary transfer belt 21 remain slackened between the intermediary transfer belt cleaner 18 and photosensitive drum 2*a*, the driving section for the intermediary transfer belt 8 remains reduced in load by a certain amount. Since this driving section is made up of resinous gears and the like, the change in the amount of the load to which this driving section is subjected causes subtle deformation to the driving section, which in turn slows the intermediary transfer belt 8 by an amount proportional to the amount of the subtle deformation. Therefore, the moving speed of the intermediary transfer belt 8 is fastest the moment when the intermediary transfer belt 8 and secondary transfer belt 21 begin to be circularly moved. Then, as the intermediary transfer belt 8 begins to be moved, its speed gradually reduces.

That is, the moving speed of the intermediary transfer belt 8 is slower when a black monochromatic image is formed than when a yellow monochromatic image is formed. Thus, the color deviation that is attributable to the fact that the intermediary transfer belt 8 tends to move faster when a yellow monochromatic image is formed than when a black monochromatic image is formed is likely to occur (color deviation such as this one may be referred to as positive color deviation hereafter).

Figure 4:
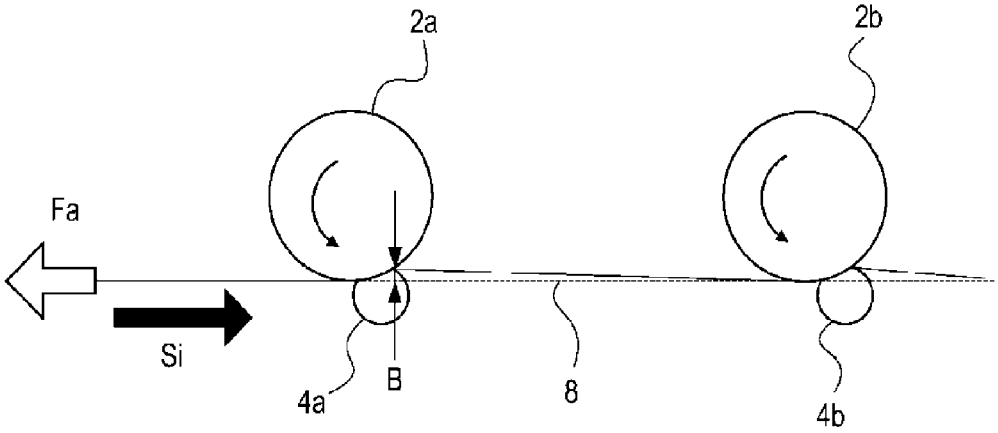
FIG. 4 is a drawing for describing the behavioral change of the intermediary transfer belt attributable to the change in the amount of friction between the image bearing belt and recording medium conveyance belt of the image forming apparatus, and the resultant formation of an image suffering from the color deviation, in the first embodiment.
Figure 4:
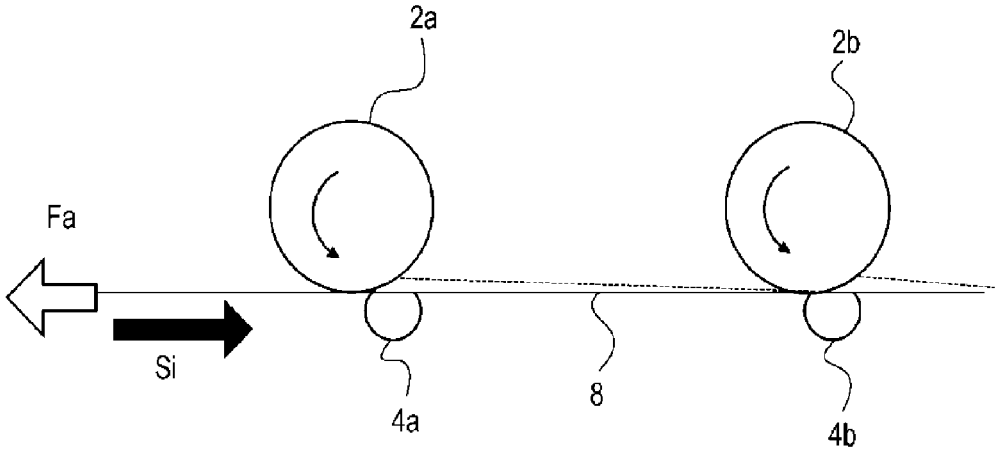

FIGS. 4(*a*) and 4(*b*) are for describing how and why the friction Fa between the intermediary transfer belt 8 and secondary transfer belt 21 acts in the direction opposite to the moving direction of the intermediary transfer belt 8. Referring to FIG. 4(*a*), the primary transfer roller 4 and photosensitive drum 2 are positioned so that the axial line of the primary transfer roller 4 is on the downstream side of the axial line of the photosensitive drum 2 in terms of the moving direction of the intermediary transfer belt 8, in order to prevent the occurrence of the phenomenon that toner scatters on the upstream side of the primary transfer station. Therefore, the portion of the intermediary transfer belt 8, which is in contact with the primary transfer roller 4, is kept raised toward the photosensitive drum 1 by a minute amount B by the primary transfer roller 4.

The moment when the intermediary transfer belt 8 and secondary transfer belt 21 begin to be circularly moved, the intermediary transfer belt 8 is braked by the friction Fa between the two belts 8 and 21. Therefore, the intermediary transfer belt 8 is increased in tension, causing its portion which is in contact with the primary transfer roller 4, to move downward, as shown in FIG. 4(*b*).

As described above, the moment when the intermediary transfer belt 8 and secondary transfer belt 21 begin to be circularly moved, the friction Fa is static. Then, as the two belts 8 and 21 start moving, it becomes dynamic. The friction Fa is greater when it is static than when it is dynamic. Therefore, the amount B by which the intermediary transfer belt 8 is kept raised is smallest in value the moment when the two belts 8 and 21 begin to be circularly moved. Then, as the two belts 8 and 21 continue to be circularly moved, the amount B gradually increases back to the original value.

While the amount B by which the portion of intermediary transfer belt 8, which is in contact with the primary transfer roller 4, is kept raised by the primary transfer roller 4, that is, the value of the amount B is no less than zero, the system for driving the intermediary transfer belt 8 remains reduced in load. Therefore, the moving speed of the intermediary transfer belt 8 is slowest the moment when the intermediary transfer belt 8 and secondary transfer belt 21 begin to be circularly moved. Then, it gradually increases as the circular movement of the intermediary transfer belt 8 continues.

That is, the moving speed of the intermediary transfer belt 8 is faster when a black monochromatic image is formed than when a yellow monochromatic image is formed. Therefore, such color deviation that a yellow monochromatic image is delayed relative to a black monochromatic image in terms of the moving direction of the intermediary transfer belt 8 is likely to occur (color deviation of this type may be referred to as minus color deviation hereafter).

As described above, the change in the friction between the intermediary transfer belt 8 and secondary transfer belt 21 changes the moving speed of the intermediary transfer belt 8, which in turn is likely to cause the plus and minus color deviations.

Figure 5A:
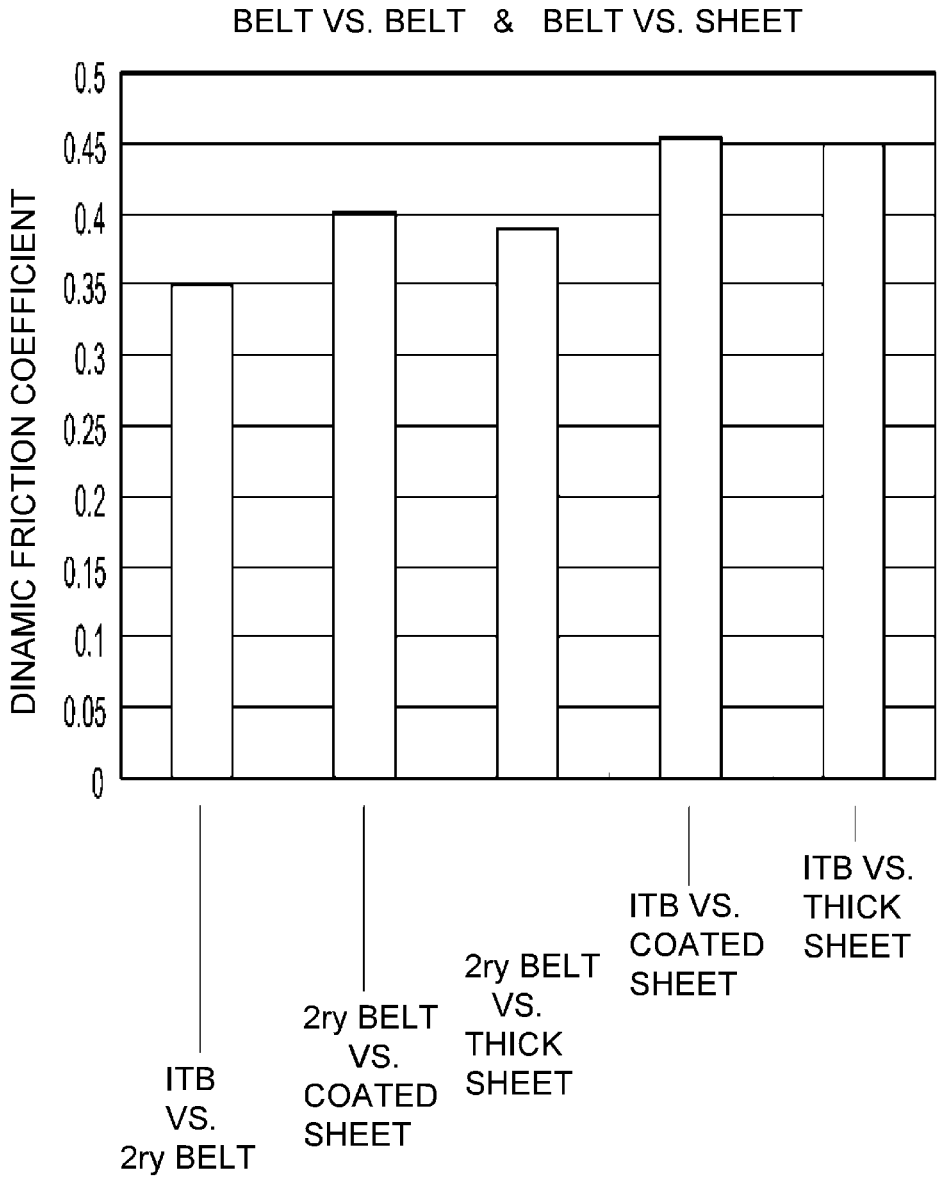
FIG. 5A is a drawing for showing among the relationship between the coefficient of friction between the image bearing belt and recording medium conveyance belt of the image forming apparatus, coefficient of dynamic friction between the intermediary transfer belt and sheets of various recording mediums, and the presence or absence of the recording medium between the two belts.

Further, the friction generated in the secondary transfer station is changed by whether there is a sheet P of recording medium in the secondary transfer station or not. FIG. 5A shows the results of the measurement of the coefficient of dynamic friction between the intermediary transfer belt 8 and secondary transfer belt 21 when there was no sheet P of recording medium between the two belts 8 and 21, and the results of the measurement of the coefficient of dynamic friction between the intermediary transfer belt 8 and secondary transfer belt 21 when there was a sheet P of recording medium between the two belts 8 and 21. The recording media used for the measurement were Color Laser Photo Paper, Glossy (product of Hewlett Packard Co., Ltd.) and cardboard which was 120 g/cm$^2$ in basis weight. The intermediary transfer belt 8 and secondary transfer belt 21 of the image forming apparatus 100 in this embodiment were different in material. Therefore, the coefficients of dynamic friction between intermediary transfer belt 8 and Color Laser Photo Paper, Glossy, between the intermediary transfer belt 8 and cardboard, between the secondary transfer belt 21 and Color Laser Photo Paper, Glossy, and between the secondary transfer belt 21 and cardboard, were separately measured.

Referring to FIG. 5A, the coefficients of dynamic friction between the two type of sheets and two belts 8 and 21 were greater than the coefficient of dynamic friction between the two belts 8 and 21. Further, the coefficients of dynamic friction between the two types of recording mediums and intermediary transfer belt 8 were greater than those between the two types of recording mediums and secondary transfer belt 21. That is, even if the intermediary transfer belt 8 and secondary transfer belt 21 are the same in speed while a sheet P of recording medium is not conveyed through the secondary transfer station, the coefficient of dynamic friction between the two belts 8 and 21 changes as a sheet P of recording medium is conveyed into the secondary transfer station in order to form an image. Thus, the intermediary transfer belt 8 and secondary transfer belt 21 become slightly different in speed. This phenomenon sometimes disturbed the toner images.

Figure 5B:
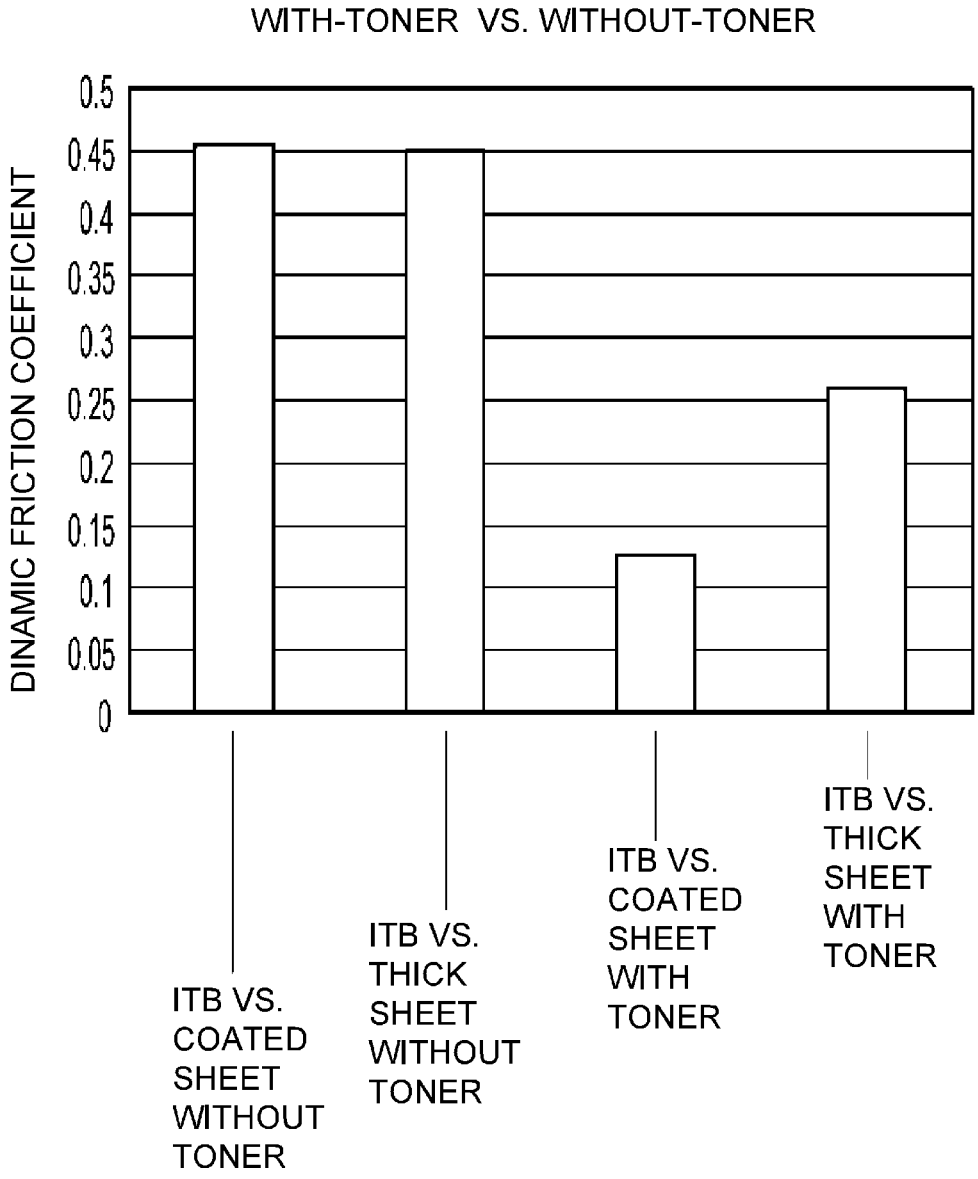
FIG. 5B is a drawing for showing the coefficient of friction between the intermediary transfer belt and each of four recording media.

Further, the friction between the intermediary transfer belt 8 and secondary transfer belt 21 is affected by whether or not toner is in the secondary transfer station. FIG. 5B shows the results of the measurement of the coefficients of dynamic friction between the intermediary transfer belt 8 and two types of recording mediums, which were affected by the presence or absence of toner in the secondary transfer station. The recording mediums used for the measurement were Color Laser Photo Paper, Glossy (product of Hewlett Packard Co., Ltd.) and cardboard which was 120 g/cm$^2$ in basis weight, like those used to obtain the results shown in FIG. 5A. Referring to FIG. 5B, the presence of toner between the intermediary transfer belt 8 and the recording medium substantially reduces the coefficient of dynamic friction between the intermediary transfer belt 8 and the recording medium. The friction Fa changes when the coefficient of dynamic friction between the intermediary transfer belt 8 and secondary transfer belt 21 changes while the two belts 8 and 21 are different in speed. That is, the coefficient of dynamic friction between the two belts 8 and 21 changes the instant when the state of the secondary transfer station changes from the one in which no toner is absent (solid white) to the one in which toner is present, while there is a slight difference in speed between the two belts 8 and 21, a phenomenon that the moving speed of a sheet P of recording medium does not match the moving speed of the intermediary transfer belt 8 occurs. Consequently, the toner images on the intermediary transfer belt 8 are disturbed in the secondary transfer station.

As described above, it is liable that because of the frictional change in the secondary transfer station, image disturbance will occur. The friction occurs because the intermediary transfer belt 8 and secondary transfer belt 21 are different in speed in the secondary transfer station. Therefore, in order to prevent the change in the friction between the two belts 8 and 21 in the secondary transfer station, it is effective to highly precisely match the moving speed of the intermediary transfer belt 8 to that of the secondary transfer belt 21.

Figure 6:
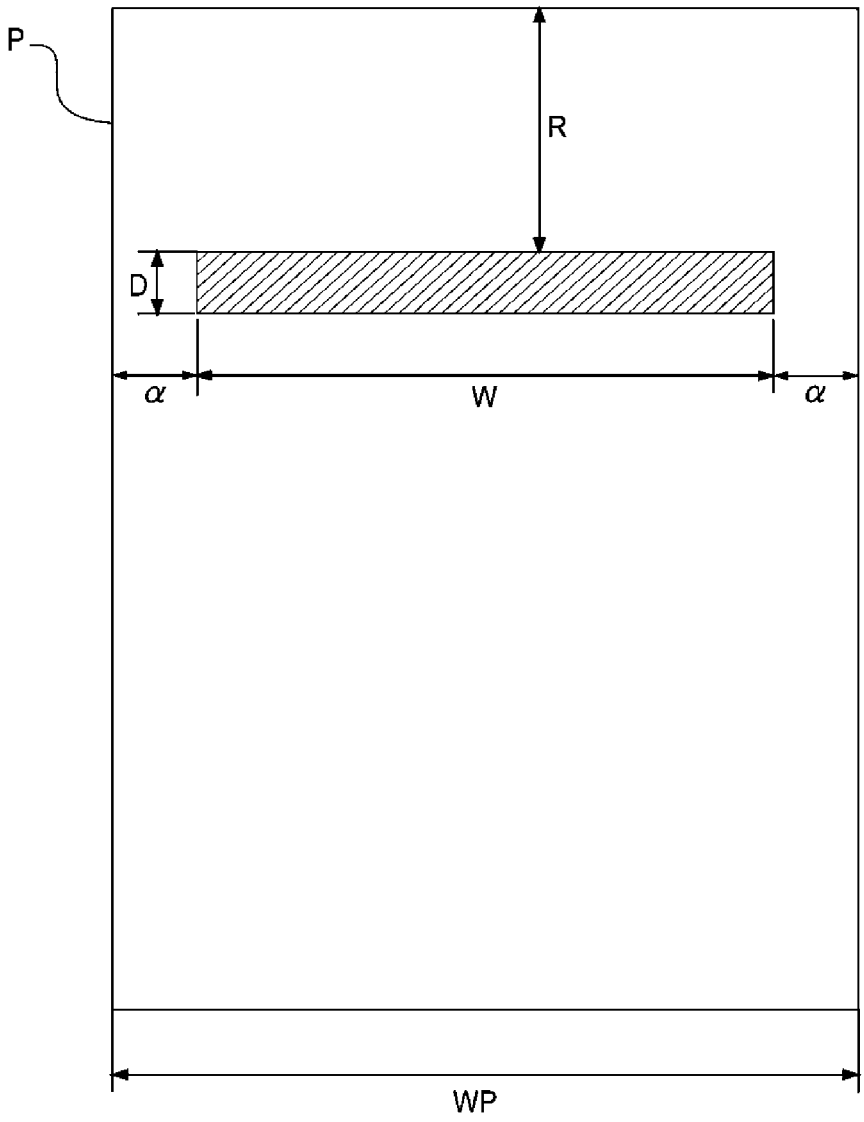
FIG. 6 is a plan view of the sheet used for the detection of the image blurring.

FIG. 6 is a drawing of the pattern formed of toner to be used for matching the moving speed of the intermediary transfer belt 8 to that of the secondary transfer belt 21. The pattern formed in this embodiment is a halftone pattern made up of multiple horizontal lines, the width of each of which is equivalent to two dots (at 600 dpi), and the intervals of which are equivalent to three dots. This pattern is highly effective to detect image blur. In terms of the direction parallel with the moving direction of the intermediary transfer belt 8, the dimension of the image TP in FIG. 6 is D, and in terms of the direction perpendicular to the moving direction of the intermediary transfer belt 8, it is W.

Figure 7:
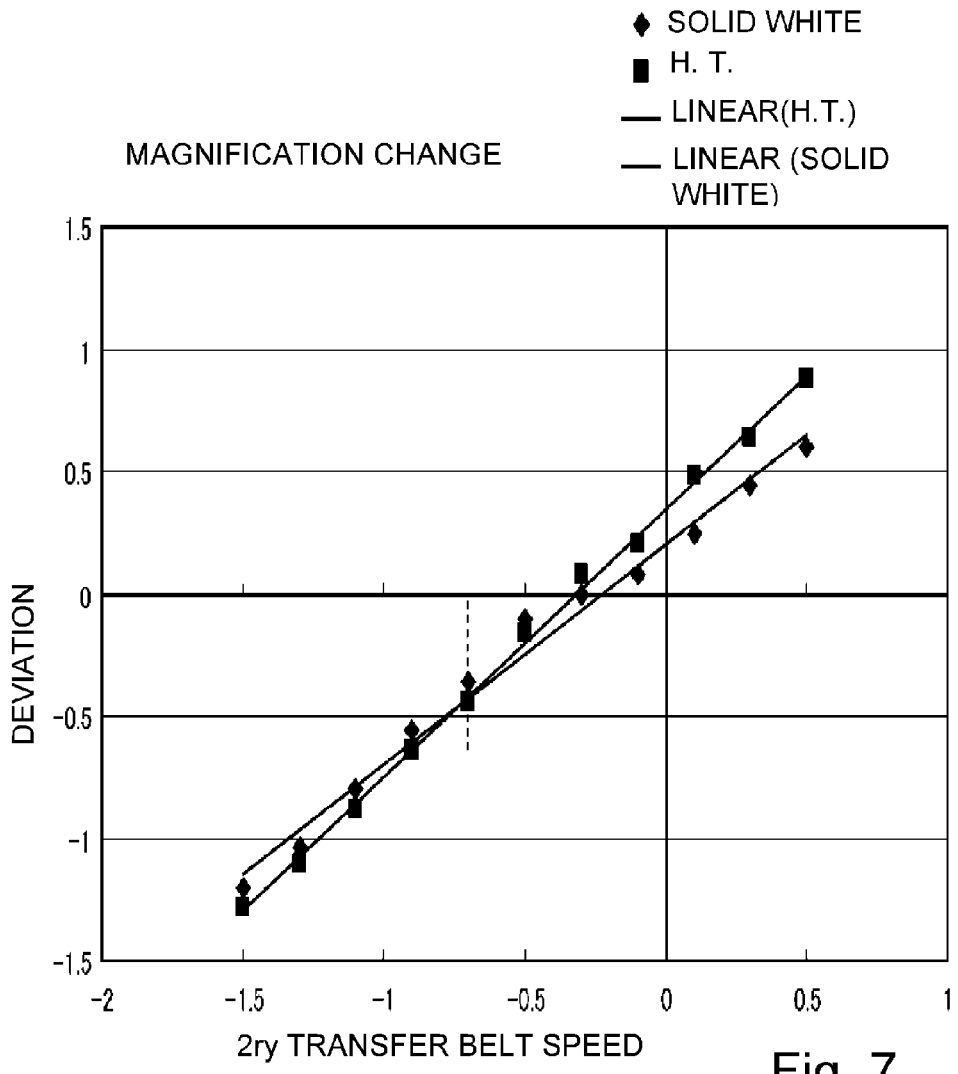
FIG. 7(*a*) is a table which shows the relationship between the speed of the secondary transfer belt and the ranking of the image blurring.

FIG. 7(*a*) is a drawing which shows the results of the experiments carried out to determine the relationship between the difference in speed between the intermediary transfer belt 8 and secondary transfer belt 21 and the extent of image blur. Image blur occurs as a toner image is transferred onto an area of a sheet P of recording medium, which is slightly displaced from the intended area, because of the occurrence of the change in the moving speed of the intermediary transfer belt 8 from the preset one, during image transfer. In a case where multiple monochromatic toner images, different in color, are transferred in layers onto the intermediary transfer belt 8, image blur sometimes occurs, which in turn results in color deviation.

In FIG. 7(*a*), the horizontal axis stands for the speed of the secondary transfer belt 21, which is expressed as ratio (percent) of deviation from the design center value. Incidentally, the design center value for the secondary transfer belt 21 and that for the intermediary transfer belt 8 are the same. The recording mediums used for the measurement were Color Laser Photo Paper, Glossy (product of Hewlett Packard Co., Ltd.), which is gloss coat paper. The reason why gloss coat paper was used is that the coefficient of dynamic friction between the intermediary transfer belt 8 and the recording medium is greater when the recording medium is gloss coat paper than when the recording medium is cardboard as is evident from FIG. 5B, and therefore, using gloss coat paper as the recording medium makes it possible to more precisely detect "image blur" than using cardboard.

The rankings A-D are average rankings of a preset number of images which were continuously outputted with the use of each of the two types of recording mediums. "A" means absence of blur; "B", presence of microscopic blur (undetectable with the human eye, but detectible with use of a microscope); "C", presence of blur (detectable with only the keenest of human eyes; and "D" means presence of obtrusive blur (problematic to user).

Referring to FIG. 7(*a*), when the speed of the secondary transfer belt 21 was kept within a range of 0.8-0.5% of the speed of the intermediary transfer belt 8, satisfactory images were obtained. The reason why satisfactory images were not obtained unless the speed of the secondary transfer belt 21 was slightly slower than its design center value is that component accuracy was offset from design center value. It is reasonable to think, based on the results of the experiments given in FIG. 7(*a*), that if component accuracy is not offset from the design center value, the image ranking will be highest when the difference in speed between the intermediary transfer belt 8 and secondary transfer belt 21 is zero, and the greater the difference, the worse the image ranking.

It is evident from FIG. 7(*b*) that an image which is free of problems can be obtained by designing an image forming apparatus so that even if the coefficient of dynamic friction between the intermediary transfer belt 8 and secondary transfer belt 21 in the secondary transfer station is substantially affected by the presence or absence of toner in the secondary transfer station, there will be no difference between the speed of the intermediary transfer belt 8 and that of the secondary transfer belt 21 in the second transfer station. It is also evident from FIG. 7(*b*) that the intermediary transfer belt 8 and secondary transfer belt 21 are required to highly precisely match in speed in the secondary transfer station.

FIG. 7(*b*) is a drawing for showing the results of the detailed studies of the effects of the presence or absence of toner in the secondary transfer station, upon the moving speed of a sheet P of recording medium through the secondary transfer station. The horizontal axis stands for the speed of the secondary transfer belt 21, which is expressed as the ratio (percent) of deviation from the design center value.

FIG. 7(*b*) shows the relationship between the speed of the secondary transfer belt 21 and the changes in the image magnification ratio when the image formation area of a sheet P of recording medium was entirely covered with a halftone image made up of multiple horizontal lines, width and intervals of which were equivalent to two dots and three dots, respectively (at 600 DPI), and the relationship between the speed of the secondary transfer belt 21 and the presence or absence of toner in the secondary transfer station. "Image magnification ratio" means the amount (ratio) of the blurring of a toner image which occurs during the transfer of the toner image. For example, it means the amount of the blurring of a given one of the above-described horizontal lines from its intended position on a sheet of recording medium.

Referring to FIG. 7(*b*), the change in the ratio of the image magnification ratio is greater when the background portion of an image is in the secondary transfer station, that is, when the amount of toner in the secondary transfer station is smaller, than when the halftone portion of an image is in the secondary transfer station, that is, when the amount of toner in the secondary transfer station, is larger, for the following reason. That is, the presence of toner between the intermediary transfer belt 8 and a sheet P of recording medium reduces the coefficient of friction between the intermediary transfer belt 8 and sheet P, which in turn makes the friction between the secondary transfer belt 21 and sheet P greater than the friction between the intermediary transfer belt 8 and sheet P. Therefore, the effect of the change in the speed of the secondary transfer belt 21 upon the moving speed of the sheet P becomes greater.

Further, it is evident from FIG. 7(*b*) that it is when the speed of the secondary transfer belt 21 is roughly −0.7% that the image magnification ratio of the solid white background portion of an image is the same as that of the halftone portion of the image. Further, it is evident from FIG. 7(*a*) that excellent images were obtained when the speed of the secondary transfer belt 21 was roughly −0.7%.

In other words, as long as it is possible to highly precisely match the intermediary transfer belt 8 and secondary transfer belt 21 in moving speed, it is possible to prevent the occurrence of the image blur. Thus, the image forming apparatus 100 in this embodiment was designed so that it can be operated in the adjustment mode in which it can output the relationship between the amount of the image blur and the relative speed between the speed of the intermediary transfer belt 8 and that of the secondary transfer belt 21.

Figure 8:
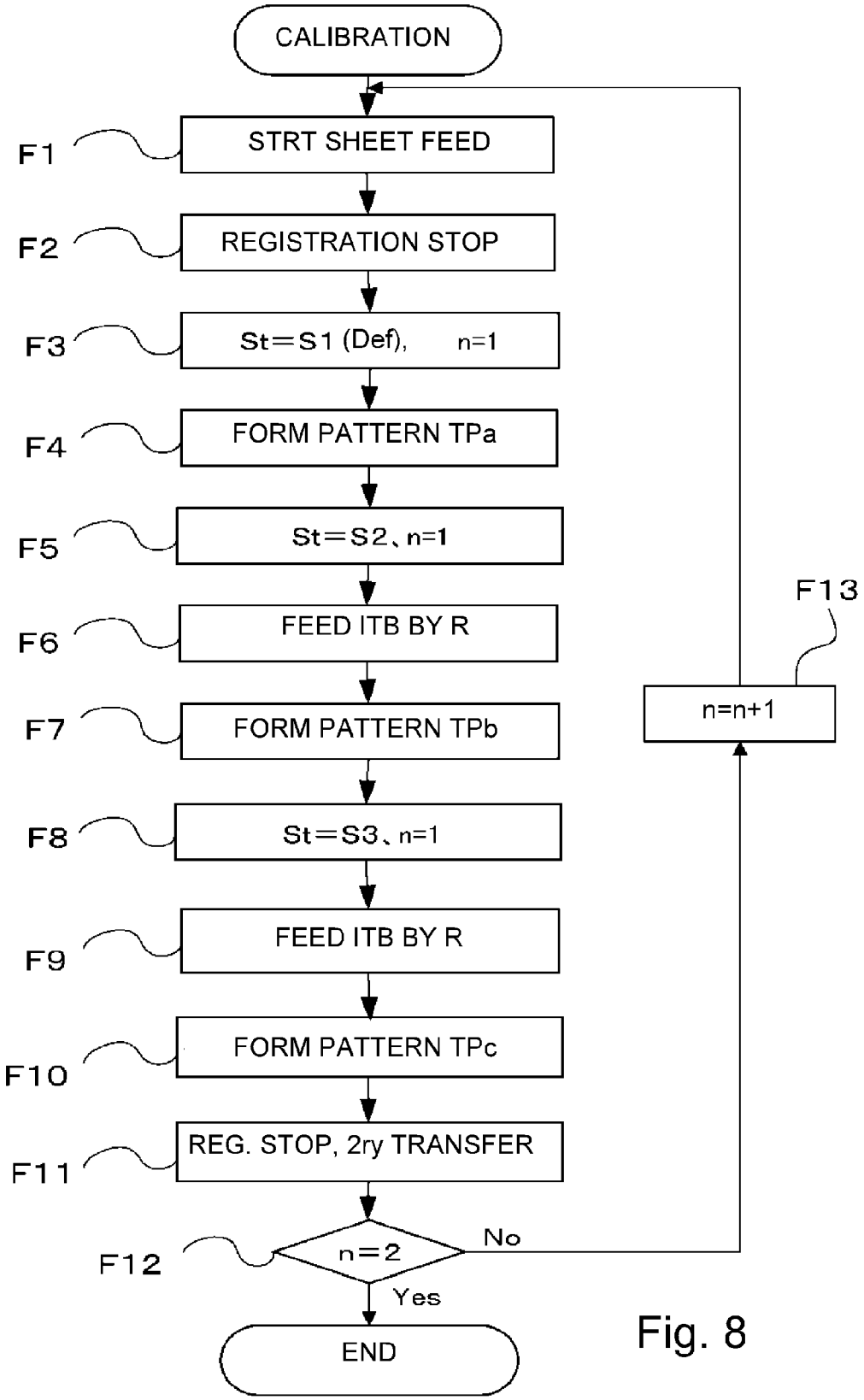
FIG. 8 is a flowchart of the control sequence for controlling the speed of the secondary transfer belt in the first embodiment.

FIG. 8 is a flowchart of the operational sequence of the image forming apparatus 100 in the adjustment mode. Referring to FIG. 8, first, one of the sheets P of recording medium in the sheet feeder cassette 30 is conveyed to the pair of registration rollers 33 (F1), and is stopped as it is pinched by the registration rollers 33 (F2).

The recording medium which is to be used in the adjustment mode is desired to be gloss coat paper, for the following reason. That is, as shown in FIG. 5B, gloss coat paper is greater than cardboard in the amount of difference in the coefficient of dynamic friction between the intermediary transfer belt 8 and secondary transfer belt 21, between when toner is present in the secondary transfer station and when toner is absent in the secondary transfer station, being therefore superior to the gloss coat paper in terms of the detection of image blur.

The speed St of the secondary transfer belt 21 is set to S1, and the value of variable n is set to 1. Then, the driving of the intermediary transfer belt 8 and secondary transfer belt 21 is started (F3). The ratio between the speed of the intermediary transfer belt 8 and that of the secondary transfer belt 21 when the two belts 8 and 21 began to be driven is the first relative speed. Incidentally, the speed S1 of the secondary transfer belt 21 is the design center value, and is stored in the ROM 71 of the image formation controlling section. In this embodiment, the relative speed between the intermediary transfer belt 8 and secondary transfer belt 21 is changed by changing the moving speed of the secondary transfer belt 21 without changing the moving speed of the intermediary transfer belt 8.

Figure 9:
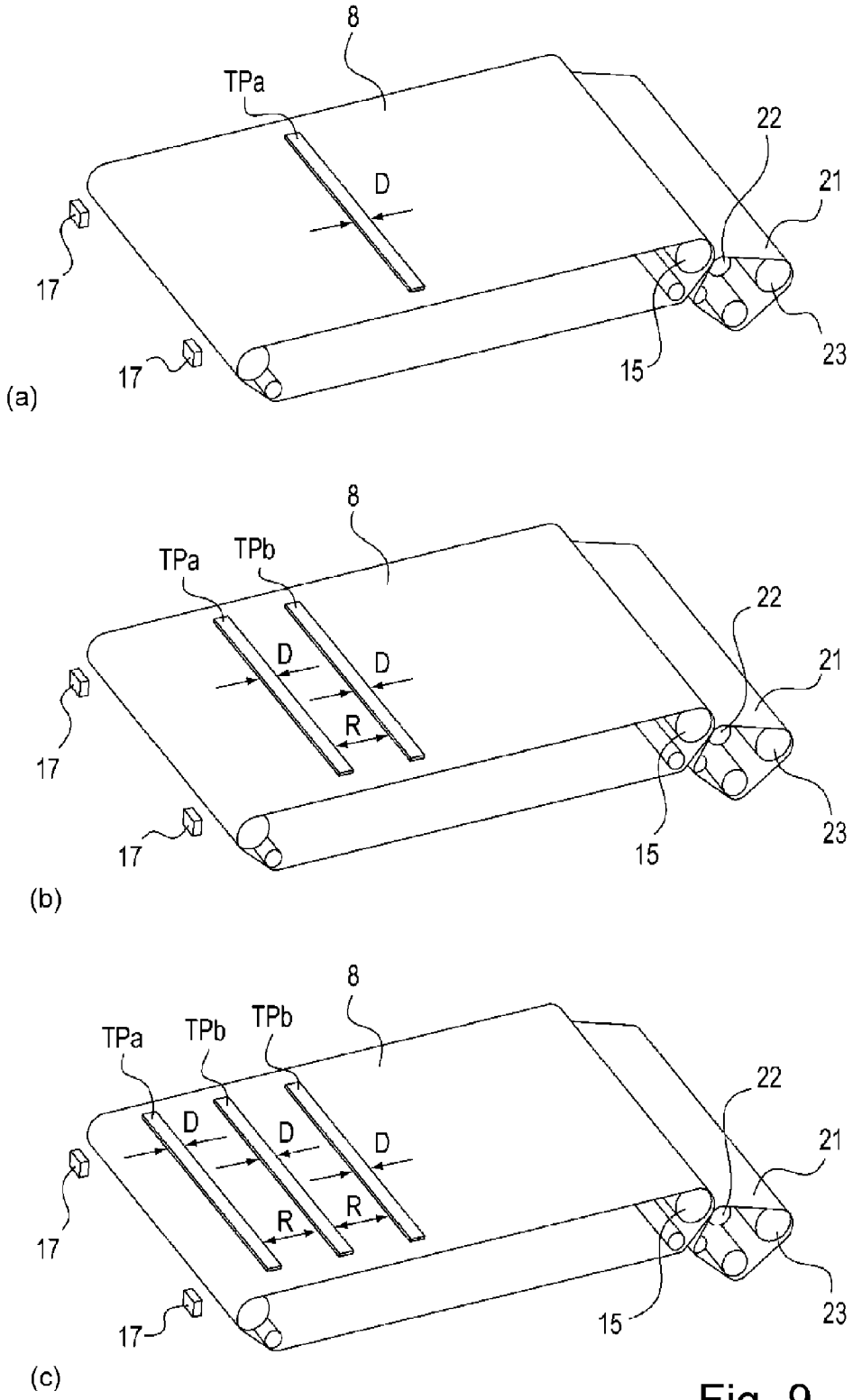
FIG. 9 is a perspective view of the intermediary transfer belt unit in the first embodiment of the present invention.

Next, a pattern such as the pattern TPa shown in FIG. 9(*b*) is formed of toner on the intermediary transfer belt 8 (F4). The pattern TPa is formed in the image formation station for a monochromatic black image (which hereafter may be referred to simply as "black station"). The reason why the pattern TPa is formed in the black station is that the blurring of a black image is easier to visually detect than the blurring of the images of other colors. The pattern TPa may be formed of cyan, magenta, or yellow toner, although the usage of these toners makes it less easy to visually detect the image blur.

Figure 10:
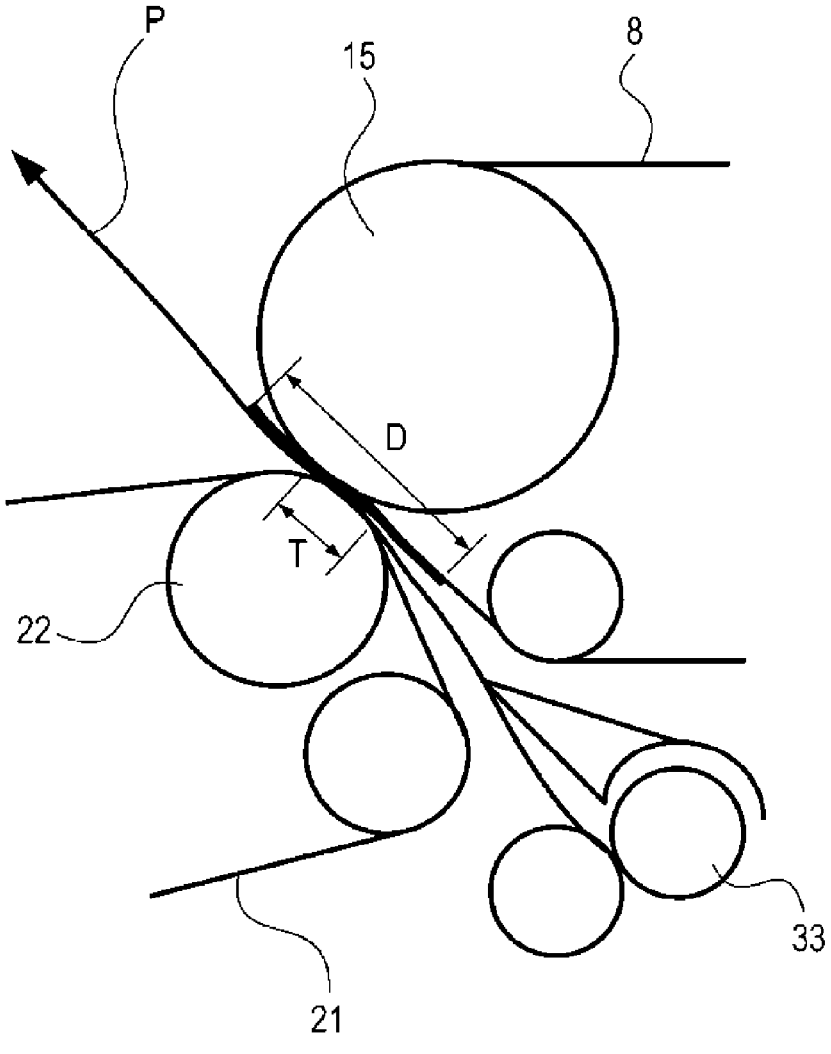
FIG. 10(*a*) is an enlarged sectional view of the secondary transfer station.

The dimension (width D) of the pattern TPa in terms of the direction (secondary scan direction) parallel with the moving direction of the intermediary transfer belt 8 is D. Referring to FIG. 10(*a*), the width D of the pattern TPa is made significantly wider than the width T of the secondary transfer station, for the following reason. That is, if the width D of the pattern TPa is less than the width T of the secondary transfer station, the amount of difference of the coefficient of friction between when toner is present in the secondary transfer station transfer station and when toner is absent in the secondary transfer station transfer station is small, and therefore, it is difficult for the image blur to be detected. In this embodiment, the width D of the pattern TPa was set to a value in a range of roughly 15 mm-30 mm.

Regarding the amount of the toner in the secondary transfer station transfer station, in addition to the width T of the secondary transfer station transfer station, the width W of the pattern TPa in terms of the primary scan direction (moving direction of the intermediary transfer belt 8) also is an important parameter. FIG. 10(*b*) is a table which shows the results of the experiment performed to obtain the relationship between the width W of the pattern TPa (portion of sheet of recording medium, which has toner, in FIG. 6) and the margin α, that is, half the amount of difference between the width WP of a sheet of recording medium and the width W of the pattern TPa. The standard used to evaluate images to obtain image rankings A-D is the same as the one used to obtain the rankings given in FIG. 7(*a*). The sheet P of recording medium used for the experiment was of the letter size. In order to make it easier for the burring of image to occur, images were printed with the provision of a speed difference between the intermediary transfer belt 8 and secondary transfer belt 21.

Referring to FIG. 10(*b*), increasing lateral margins, that is, reducing the width W (dimension in primary scan direction) of the pattern TPa, reduces the extent of image blur. It is evident from the results of the experiment that in order to make it easier for the image blur to be detected, the lateral margin a has to be no less than zero. More concretely, it is desired that the width W (dimension in primary scan direction) is no less than ⅓ of the width WP of a sheet P of recording medium.

Next, the speed St of the secondary transfer belt 21 is set to S2, and the driving of the intermediary transfer belt 8 and secondary transfer belt 21 is started (F5). The speed S2 is 0.1% slower than the speed 51. The ratio between the speeds S2 and 51 does not need to be 0.1%. That is, the optimal ratio between the speeds S2 and 51 is affected by the structure and precision of the components related to the peripheral velocity of each belt. The relative speed between the intermediary transfer belt 8 and secondary transfer belt 21 when the speed of the secondary transfer belt 21 is S2 is different from that when the speed of the secondary transfer belt 21 is S1.

Next, the intermediary transfer belt 8 is moved by a preset distance (interval) R (F6). The distance R by which the intermediary transfer belt 8 is moved is the distance between the pattern TPa, and a pattern TPb which is described later. The distance R also is one of the important parameters for detecting the image blur. If the image forming apparatus 100 is in the state in which there is a difference between the moving speed of the intermediary transfer belt 8 and that of the secondary transfer belt 21, the slack L, which was described with reference to FIG. 3, is not generated, nor the intermediary transfer belt 8 is pressed downward by the amount B described with reference to FIGS. 4(*a*) and 4(*b*), unless there is a period in which the intermediary transfer belt 8 and secondary transfer belt 21 are in contact with each other with the presence of a sheet P between the two belts 8 and 21.

Figure 11:
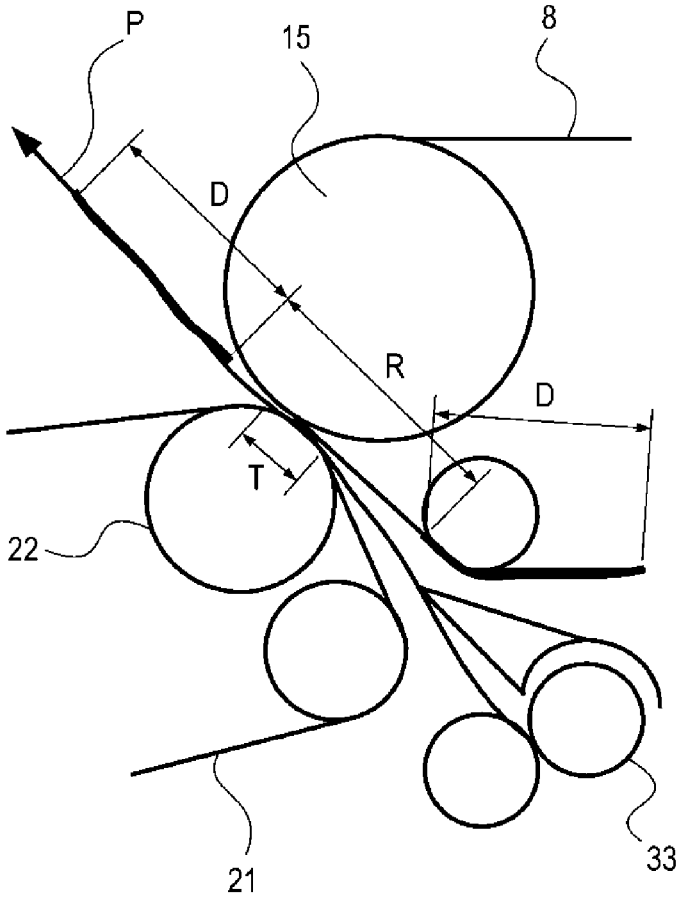
FIG. 11 also is an enlarged sectional view of the secondary transfer station.
Figure 12:
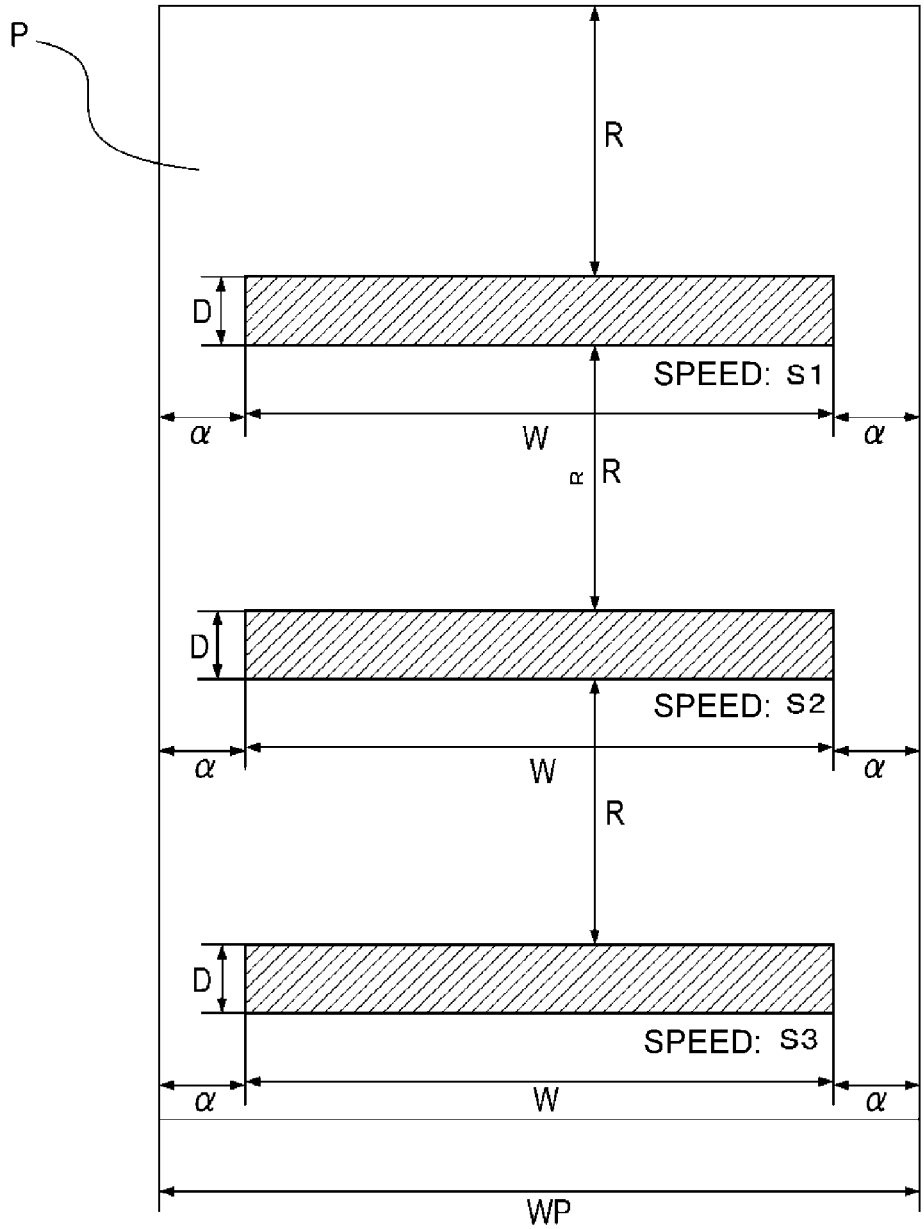
FIG. 12 is a plan view of the sheet of recording medium having test patterns formed of toner.

Referring to FIG. 11, the distance R by which intermediary transfer belt 8 has to be moved to detect the image blur has only to be greater than the width T of the secondary transfer nip T. However, in consideration of the time required to change the speed of the secondary transfer belt 21 from the speed S1 to the speed S2, and also, from the standpoint of detecting the image blur as precisely as possible, the distance R by which the intermediary transfer belt 8 is to be moved for the detection of the image blur is desired to be set to as large a value as possible. In this embodiment, it was set to a value in a range of roughly 50 mm-80 mm.

Next, a pattern TPb is formed of toner, on the intermediary transfer belt 8 as shown in FIG. 9(*b*) (F7). The widths D (dimension in secondary scan direction) and W (dimension in primary scan direction) are the same the widths D and W of the pattern TPa, respectively.

Next, the speed St of the secondary transfer belt 21 is set to S3, and the driving of the intermediary transfer belt 8 and secondary transfer belt 21 is started (F8). The speed S3 is faster than the speed S2 by 0.1%. The ratio between the speeds S3 and S2 is not limited to 0.1%. That is, the optimal value for this ratio is affected by the structure and precision of the components related to the peripheral velocity of each belt. The speed of the intermediary transfer belt 8 relative to the secondary transfer belt 21 when the speed of the secondary transfer belt 21 is S3 was different from both the speed of the intermediary transfer belt 8 relative to the secondary transfer belt 21 when the speed of the secondary transfer belt 21 is S1, and the speed of the intermediary transfer belt 8 relative to the speed of the secondary transfer belt 21 when the speed of the secondary transfer belt 21 is S2.

Next, the intermediary transfer belt 8 is moved by the preset distance R (F9). Then, a pattern TPc is formed of toner on the intermediary transfer belt 8 as shown in FIG. 9(*c*) (F10). Then, the sheet P of recording medium, which has been held stationary by the pair of registration rollers 33, remaining pinched by the registration rollers 33, begins to be conveyed, and the patterns TPa, TPb and TPc formed of toner on the intermediary transfer belt 8 are transferred together (secondary transfer) onto the sheet P (F11). Then, the sheet P bearing the patterns TPa, TPb and TPc formed of toner is conveyed through the fixation unit, in which the patterns TPa, TPb and Tbc are fixed to the sheet P. Then, the sheet P is discharged into the delivery tray 45.

Then, it is checked whether or not the value of the variable n is 2 (F12). If the value of the variable n is not 2, one is added to the variable n: n=n+1 (F13), and the steps F1-F11 are repeated. In this embodiment, the value of the variable n was set to 2. However, the value to which the variable n is set in step F13 is not limited to 2. If it is determined the value of the variable n is 2, the adjustment mode is ended.

Then, the operator is to visually check the patterns TPa, TPb and TPc on the sheet P, which were transferred onto the sheet P in the adjustment mode. Then, the operator is to select the best pattern TPa, that is, the pattern TP which is smallest in the amount of blurring. Then, the operator is to make the image formation controlling section 62 set the speed of the intermediary transfer belt 8 relative to the secondary transfer belt 21, to the value which corresponds to the selected pattern TP. In the case of the image forming apparatus in this embodiment, the optimum relative speed is set by storing it in the RAM 72 by inputting the speeds S1, S2 and S3 through the external host device 50, such as a personal computer, which is connected so that it can communicate with the image forming apparatus, or through the control panel 67 with which the image forming apparatus 100 is provided separately from the main assembly of the apparatus 100.

It is possible to operate the image forming apparatus 100 in the adjustment mode during its production. Operating the image forming apparatus 100 in the adjustment mode during its production makes it possible for a user to reliably obtain excellent images the moment the image forming apparatus 100 is put to use for the first time. The image forming apparatus 100 should be operated in the adjustment mode also immediately after at least one of the intermediary transfer belt unit and secondary transfer belt unit is replaced. The reason for this practice is that the moving speed of each belt is subtly affected by the thickness of each belt, and the external diameter of each of the belt driving rollers.

It is recommended to perform the above-described calibration operation not only after the replacement of one or both belt units, but also, after the replacement of only one or both belts. Further, the image forming apparatus 100 may be designed so that the relative speed can be adjusted with optional timing by a user with use of the control panel 67 or the like. Further, in this embodiment, the image forming apparatus 100 was structured so that the speed of the secondary transfer belt 21 is to be adjusted to adjust the relative speed between the intermediary transfer belt 8 and secondary transfer belt 21. However, all that is necessary is for the relative speed between the intermediary transfer belt 8 and secondary transfer belt 21 to be adjusted. Thus, it may be the intermediary transfer belt 8 or both the intermediary transfer belt 8 and secondary transfer belt 21 that are adjusted in speed.

As described above, according to this embodiment, the three patterns TPa, TPb and TPc are formed of toner on the intermediary transfer belt 8, with the relative speed between the intermediary transfer belt 8 and secondary transfer belt 21 set at three different values, one for one, and the relative speed which is least in the amount of the image blur, is selected as the one for setting the speed for the secondary transfer belt 21 in order to make the speed of the intermediary transfer belt 8 match that of the secondary transfer belt 21 in the secondary transfer station. Therefore, each of the belts 8 and 21 can be reliably driven at a stable speed. Therefore, the user of the image forming apparatus 100 can obtain images which are free of defects.

Further, in this embodiment, the image bearing member in each image formation station of the image forming apparatus 100 was the photosensitive drum 2. However, the present invention is applicable to an image forming apparatus structured so that its image bearing member is a photosensitive belt and toner images are directly transferred from the photosensitive belt onto a sheet P of recording medium.

(Embodiment 2)

Figure 13:
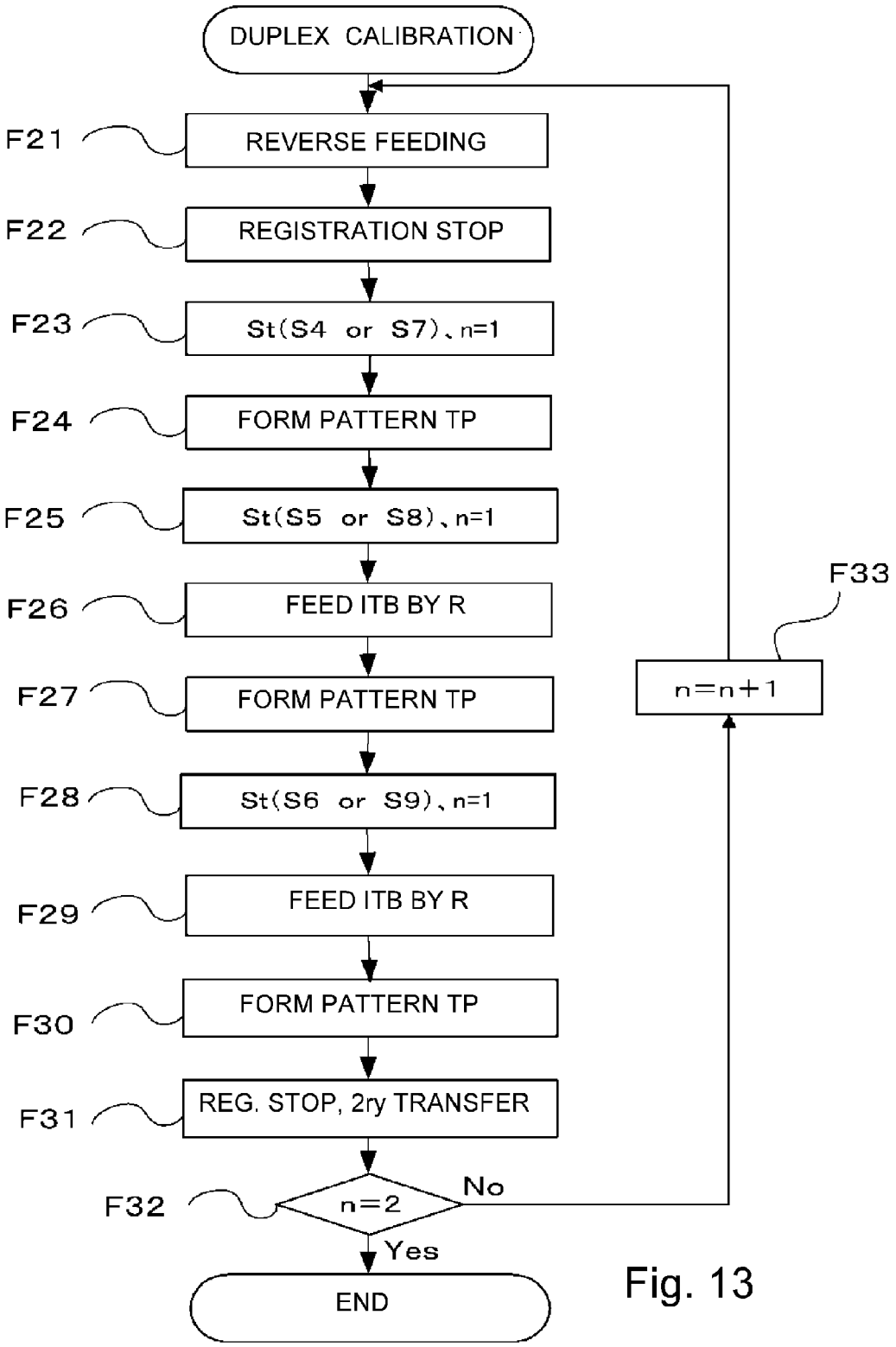
FIG. 13 is a flowchart of the control sequence for controlling the speed of the secondary transfer belt in the second embodiment.

Next, the image forming apparatus in the second preferred embodiment of the present invention is described with reference to the appended drawings. The components, portions, etc., of the image forming apparatus in this embodiment, which are the same as the counterparts of the image forming apparatus 100 in the first embodiment are given the same reference numerals and characters, one for one, as those given to the counterparts, and are not going to described here. FIG. 13 is a flowchart of the operational sequence of the image forming apparatus 100 in this embodiment, in the adjustment mode, that is, the mode for adjusting the image forming apparatus 100 in the relative speed between the intermediary transfer belt 8 and secondary transfer belt 21.

Referring to FIG. 13, the image forming apparatus 100 in this embodiment is different from the image forming apparatus in the first embodiment in that it forms the patterns TP not only on one of the two surfaces of a sheet P of recording medium, but also, on the other surface as well, with the use of its mechanism for turning over a sheet of recording medium to form an image on both surfaces of a sheet P.

In the case of the adjustment mode in the first embodiment, the calibration of the speed of the secondary transfer belt 21 was done by forming the patterns TP on only one of the two surfaces of a sheet P of recording medium. Therefore, it is limited in terms of the number of times the relative speed between the intermediary transfer belt 8 and secondary transfer belt 21 can be altered with the use of a single sheet P of recording medium. Referring to FIG. 7(*a*), because of the tolerance in the dimensions of the components, portions, etc., of the image forming apparatus 100, image blurring sometimes does not occur even when the speed of the secondary transfer belt 21 is substantially different from the design center value.

In this embodiment, therefore, the mechanism for turning over a sheet P of recording medium to form an image on both surfaces of the sheet P is utilized to double the number of the speeds to which the speed of the secondary transfer belt 21 can be changed. Thus, the relative speed between the intermediary transfer belt 8 and secondary transfer belt 21 can be changed multiple times.

In the adjustment mode shown in FIG. 8, first, the patterns TPa, TPb and TPc are formed on a sheet P of recording medium. Then, the sheet P is conveyed through the two-side mode passage G, being thereby turned over (F21). Then, it is held by the pair of registration rollers 33 (F22).

Figure 14:
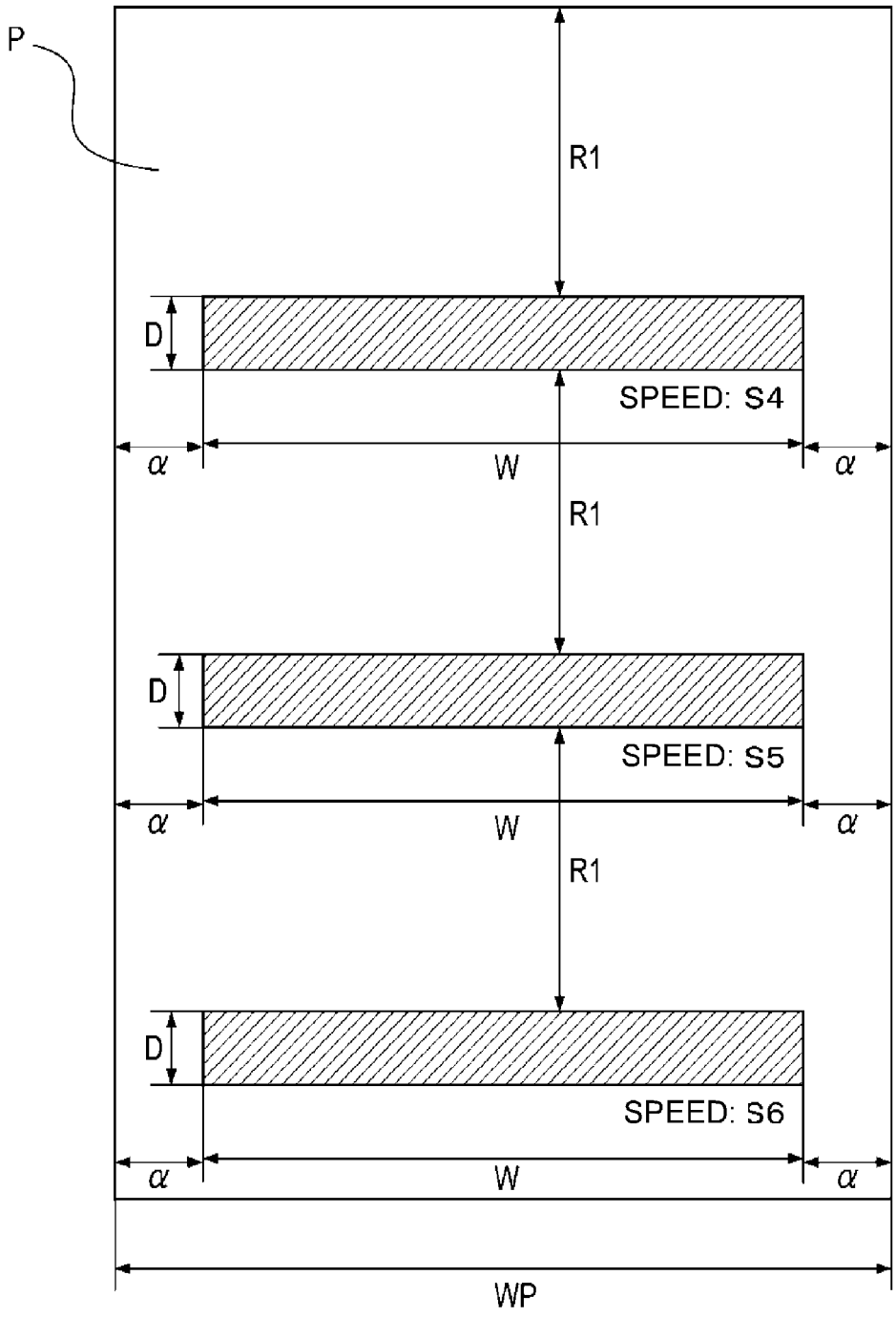
FIG. 14 is a plan view of the sheet of recording medium having test patterns formed of toner in the second embodiment.

Then, the three patterns TP shown in FIG. 14 are formed of toner on the back side (second surface) of the sheet P through steps F23-F31 as in the first embodiment. During the formation of these three patterns TP, the speed St of the secondary transfer belt 21 was set to S4, S5 and S6, one for one. The speed S4 is 0.2% slower than the speed 51, and the speed S5 is 0.2% faster than the speed 51. The speed S6 is 0.3% slower than the speed S1. The distance R1 was set to a value in a range of roughly 50 mm to 80 mm.

Figure 15:
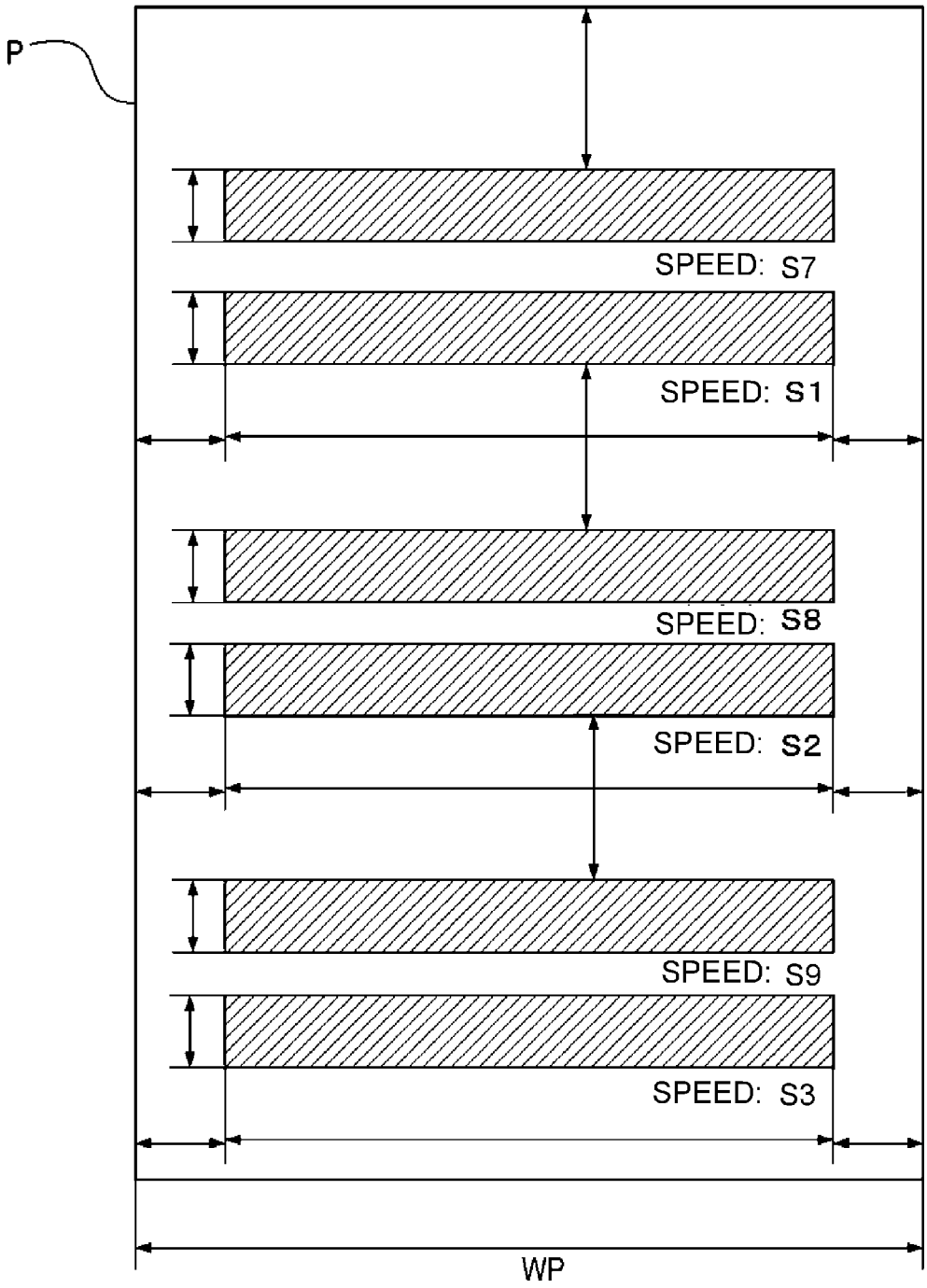
FIG. 15 also is a plan view of the sheet of recording medium having test patterns formed of toner in the second embodiment.

Next, it is determined whether the value of the variable n is 2 (F32). If n is not 2, the sheet P is again conveyed through the two-side image formation passage G. This time, the speed St of the secondary transfer belt 21 is set to S7, S8 and S9, and three patterns TP shown in FIG. 15 are formed, respectively, on the surface of the sheet P, which has the patterns TPa, TPb and TPc (F21-F31).

The speed S7 is 0.3% faster than the speed 51, and the speed S8 is 0.4% slower than the speed S1. The speed S9 is 0.4% faster than the speed 51. The values to which the speed St of the secondary transfer belt 21 is to be set do not need to be the above-mentioned ones. The optimal value for the speed St of the secondary transfer belt 21 is affected by the structure and preciseness of each of the components, portions, etc., which are related to the peripheral velocity of each belt. Further, the distance R2 by which the intermediary transfer belt 8 is to be moved is set to a value which is in a range of roughly 50 mm-80 mm and does not make the second set of three patterns TP overlap with the first set of patterns TPa, TPb and TPc on the first surface of the sheet P.

Further, the number of times the sheet P is to be conveyed through the mechanism for turning over a sheet P of recording medium for the two-side mode does not need to be limited to one. That is, as long as the distance R by which the secondary transfer belt 21 is moved remains greater than the width T of the secondary transfer station, the sheet P may be conveyed through the mechanism multiple times.

As described above, according to this embodiment, the number of times multiple patterns TP are formed of toner on a sheet P of recording medium at multiple speeds, one for one, can be made greater than in the first embodiment. In other words, the adjustment mode can be increased in the range in which the relative speed between the intermediary transfer belt 8 and secondary transfer belt 21 can be changed, and therefore, it is possible to more precisely select a value for the relative speed to prevent the formation of blurred images. Therefore, each of the belts 8 and 21 is always reliably driven, making it possible for a user to obtain images which are free of defects.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 027156/2011 filed Feb. 10, 2011 which is hereby incorporated by reference.

What is claimed is:

1. An image forming apparatus comprising:

an image carrying belt, movable along an endless path, for carrying a toner image;

a first driver for rotating said image carrying belt along the endless path;

an image forming station for forming a toner image on said image carrying belt;

a sheet feeding belt, movable along an endless path, for feeding a sheet;

a transfer member for transferring the toner image from said image carrying belt onto the sheet fed on said sheet feeding belt;

a second driver for rotating said sheet feeding belt along the endless path; and a controller for controlling a moving speed of said image carrying belt and a moving speed of said sheet feeding belt, wherein said controller is capable of controlling a relative speed between said image carrying belt and said sheet feeding belt at a plurality of levels, wherein said image forming station forms a first toner pattern on said image carrying belt in a state that the relative speed is at a first level, and forms a second toner pattern on said image carrying belt in a state that the relative speed is at a second level which is different from the first level, and wherein said transfer member transfers the first toner pattern and the second toner pattern onto the sheet carried on said sheet feeding belt.

2. An apparatus according to claim 1, further comprising a fixing unit for fixing the first toner pattern and the second toner pattern transferred onto the sheet, the sheet having the fixed first toner pattern and the fixed second toner pattern is discharged to an outside of a main assembly of said apparatus.

3. An apparatus according to claim 2, further comprising an operating portion for setting the relative speed in response to instructions selected on said operating portion after the sheet having the fixed first toner pattern and the fixed second toner pattern.

4. An apparatus according to claim 2, further comprising a reversing mechanism for reversing the sheet having the fixed first toner pattern and the fixed second toner pattern to refeed it to the contact portion, wherein said image forming station forms a third toner pattern on said image carrying belt in a state that the relative speed between said image carrying belt and said sheet feeding belt is at a third level, and forms a fourth toner pattern on said image carrying belt in a state that the relative speed at a fourth level, wherein said transfer member transfers the third toner pattern and the fourth toner pattern onto a back side of the sheet not having the fixed first toner pattern and the fixed second toner patter.

5. An apparatus according to claim 1, wherein the first toner pattern and the second toner pattern are formed by black toner.

6. An apparatus according to claim 1, wherein lengths of the first toner pattern and the second toner pattern as measured in a moving direction of said image carrying belt are larger than a length of a contact portion between said image carrying belt and said sheet feeding belt.

7. An apparatus according to claim 1, wherein widths of the first toner pattern and the second toner pattern as measured in a direction perpendicular to a moving direction of said image carrying belt are smaller than that of the sheet carried on said sheet feeding belt.

8. An apparatus according to claim 1, wherein a gap between the first toner pattern and the second toner pattern as measured in a moving direction of said image carrying belt is longer than a length of a contact portion between said image carrying belt and said sheet feeding belt.

9. An apparatus according to claim 1, wherein said image carrying belt is an intermediary transfer belt onto which the toner image is primary transferred from a photosensitive member, and said sheet feeding belt is a secondary transfer belt contacting said intermediary transfer belt to form a secondary transfer portion.

10. An apparatus according to claim 9, wherein said controller changes the relative speed by changing a moving speed of said sheet feeding belt while maintaining a moving speed of said intermediary transfer belt.

* * * * *